US009523469B2

(12) United States Patent
Bauer et al.

(10) Patent No.: US 9,523,469 B2
(45) Date of Patent: Dec. 20, 2016

(54) LIGHTING SYSTEM FOR CABINET DISPLAY CASE

(75) Inventors: Joshua G. Bauer, Ames, IA (US); Patrick Trese, Cicero, IN (US)

(73) Assignee: Innovative Lighting, Inc., Roland, IA (US)

( * ) Notice: Subject to any disclaimer, the term of this patent is extended or adjusted under 35 U.S.C. 154(b) by 2019 days.

(21) Appl. No.: 12/549,041

(22) Filed: Aug. 27, 2009

(65) Prior Publication Data

US 2011/0051401 A1 Mar. 3, 2011

(51) Int. Cl.

| | |
|---|---|
| ***F21S 4/00*** | (2016.01) |
| *A47F 3/00* | (2006.01) |
| *A47F 11/10* | (2006.01) |
| *F25D 27/00* | (2006.01) |
| *F21Y 101/00* | (2016.01) |

(52) U.S. Cl.

CPC ..... *F21S 4/28* (2016.01); *A47F 3/001* (2013.01); *A47F 11/10* (2013.01); *F21Y 2101/00* (2013.01); *F25D 27/00* (2013.01)

(58) Field of Classification Search

USPC ..... 362/125, 133, 217.16, 217.17, 249.02,362/249.01

See application file for complete search history.

(56) References Cited

U.S. PATENT DOCUMENTS

| | | | | |
|---|---|---|---|---|
| 5,301,092 | A * | 4/1994 | Santosuosso et al. | 362/125 |
| 5,548,494 | A * | 8/1996 | Blackman | 362/183 |
| 5,645,330 | A | 7/1997 | Artwohl | |
| 5,873,646 | A | 2/1999 | Fjaestad | |
| 6,550,269 | B2 | 4/2003 | Rudick | |
| 6,578,978 | B1 | 6/2003 | Upton | |
| 6,578,979 | B2 | 6/2003 | Truttmann-Battig | |
| 6,726,341 | B2 | 4/2004 | Pashley | |
| 6,804,974 | B1 | 10/2004 | Voglewede | |
| 6,846,095 | B2 | 1/2005 | McClanahan | |
| 6,858,986 | B2 * | 2/2005 | Monk | 315/76 |
| 7,038,398 | B1 | 5/2006 | Lys | |
| 7,107,779 | B2 | 9/2006 | Avenwedde | |
| 7,121,675 | B2 | 10/2006 | Ter-Hovhannisian | |
| 7,210,808 | B2 | 5/2007 | Malpetti | |
| 7,240,506 | B2 | 7/2007 | Grassmuck | |
| 7,273,300 | B2 * | 9/2007 | Mrakovich | 362/249.01 |
| 7,331,689 | B2 | 2/2008 | Chen | |
| 7,338,180 | B2 | 3/2008 | Wing | |
| 7,407,240 | B2 | 8/2008 | Collins | |
| 7,410,230 | B2 | 8/2008 | Anderson | |
| 7,513,637 | B2 | 4/2009 | Kelly | |
| 8,066,402 | B2 * | 11/2011 | Klipstein | 362/205 |
| 2004/0062031 | A1 | 4/2004 | Pinter | |
| 2007/0195535 | A1 | 8/2007 | Artwohl | |
| 2008/0007945 | A1 | 1/2008 | Kelly | |
| 2008/0094824 | A1 | 4/2008 | Stack | |
| 2008/0158858 | A1 | 7/2008 | Madireddi | |
| 2008/0198600 | A1 | 8/2008 | Crandell | |
| 2008/0205045 | A1 | 8/2008 | Herper | |
| 2008/0219002 | A1 | 9/2008 | Sommers | |
| 2008/0277361 | A1 | 11/2008 | Primiano | |

* cited by examiner

*Primary Examiner* — Sharon Payne
(74) *Attorney, Agent, or Firm* — Daniel J. Polglaze; Westman, Champlin & Koehler, P.A.

(57) ABSTRACT

A lighting system utilizing light emitting diode lamps, designed to be mounted on the mullion inside a cabinet display case wherein the distribution of light illuminates the product in an even and consistent manner.

20 Claims, 8 Drawing Sheets

LIGHTING SYSTEM FOR CABINET DISPLAY CASE

FIELD OF THE INVENTION

The present invention relates to a lighting system for illuminating product arrayed in the interior of a cabinet display case.

BACKGROUND OF THE INVENTION

Lighting systems used to illuminate the interiors of cabinet display cases such as refrigerated display coolers can be found in most any grocery or convenience store. Originally such display refrigerators were lit with incandescent lamps very much like a typical refrigerator. The move to florescent lamps was an improvement that decreased the amount of heat generated by the lighting system. Most recently the use of light emitting diodes (LEDs) has been introduced to further decrease heat generation and to reduce the amount of electrical consumption.

The main problem that still exists when using LEDs in a cabinet display case is configuring the lights to illuminate product displayed therein. Light emitting diodes have a generally cone shaped light output when considering their intensity which means that much of the light output will be concentrated unevenly upon the displayed products if not directed into other areas besides the product. Methods to achieve the goal of even distribution of light have included: mounting the LEDs in a multitude of locations within the cabinet display case; physically orienting the LEDs toward the product; and use of reflective surfaces to redistribute the LEDs light output.

One solution taught by Wing in U.S. Pat. No. 7,338,180 is to place the LEDs on the end of the shelves that hold the product to be illuminated but this presents the problem of increasing or decreasing the amount of light based on the number of shelves used. It also requires that each shelf have wires running to and from it which creates a messy tangle when reconfiguring shelves. The only alternative is to wire the back of the cabinet with electrical connectors at each and every shelf support mount which would create a major cost deterrent due to the number of components and the more involved manufacturing method.

Other solutions attempted to mount the lights in the door but these solutions did not provide for proper lighting of the product once the cabinet door was open. The light sources also incurred repeated movement and shocks with the door opening and closing. These shocks have little effect on the LEDs but do have a detrimental effect on the wiring for the system. The wiring for door mounted LEDs itself had, by necessity, to be placed near the door axis which increased the instances of the wires becoming wedged in the door seals and therefore compromising the thermal integrity of the cabinet display case.

A solution put forth by Artwohl in U.S. Patent Application No. 2007/0195535 was to use an array of LEDs mounted in the mullions between or at the sides of refrigerated cabinet doors. This florescent light replacement solution had been anticipated by such inventors as Chen in U.S. Pat. No. 7,331,689 or Rudick in U.S. Pat. No. 6,550,269 but both lacked the ability to direct the necessary light toward the product in an even and consistent manner. Artwohl tried to improve upon Chen through the use of reflective surfaces but only a small percentage of the light could be directed to the most visible parts of the products arranged on the shelves.

Therefore what is needed is an LED generated light source system for use in a display cabinet that can be mounted in a mullion between doors, that could be easily and simply installed, that emits the majority of the light produced by the LEDs in an even and consistent distribution towards the product that is displayed on the shelves within the cabinet.

SUMMARY OF THE INVENTION

To meet these needs, the present invention provides an illumination system of LED light sources mounted to a base. The base being designed to be mounted onto or within a mullion of a display case that can be easily and simply installed without the need of obtrusive wiring. The light output of the LEDs being directed via a lens in a manner that projects the light in an even distribution to illuminate product on the shelves of the cabinet display case.

One aspect of the present invention is that the fully integrated and enclosed system is available in lengths common to the size of typical display cases and can be used alone or in combination to span any sized mullion.

Another beneficial aspect of the present invention is that the lighting apparatus is electrically connectable so that only one electrical conductor is needed for any one mullion reducing wire clutter inside the cabinet.

Yet another aspect of the present invention includes a light directing lens that distributes the light of the LEDs in a distribution pattern substantially 70 degrees to 90 degrees left and right of the cross section of the light so that a majority of the light is directed to products on a shelf within the display case.

An additional aspect of the present invention is that the elements of the present invention can be easily manufactured with a single printed circuit board with LEDs mounted perpendicular to the printed circuit board. The advantage of such a manufacture technique is its ability to be produced using an automated manufacturing process.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DETAILED DESCRIPTION OF THE PREFERRED EMBODIMENTS

In the following detailed description, reference is made to the accompanying drawings which form a part hereof, and in which is shown by way of illustration specific embodiments in which the invention may be practiced. These embodiments are described in detail sufficient to enable those skilled in the art to practice the invention, and it is to be understood that other embodiments may be utilized and that structural, logical and mechanical changes may be made without departing from the spirit and scope of the present invention. The following detailed description is, therefore, not to be taken in a limiting sense, and the scope of the present invention is defined by the appended claims.

Figure 1:
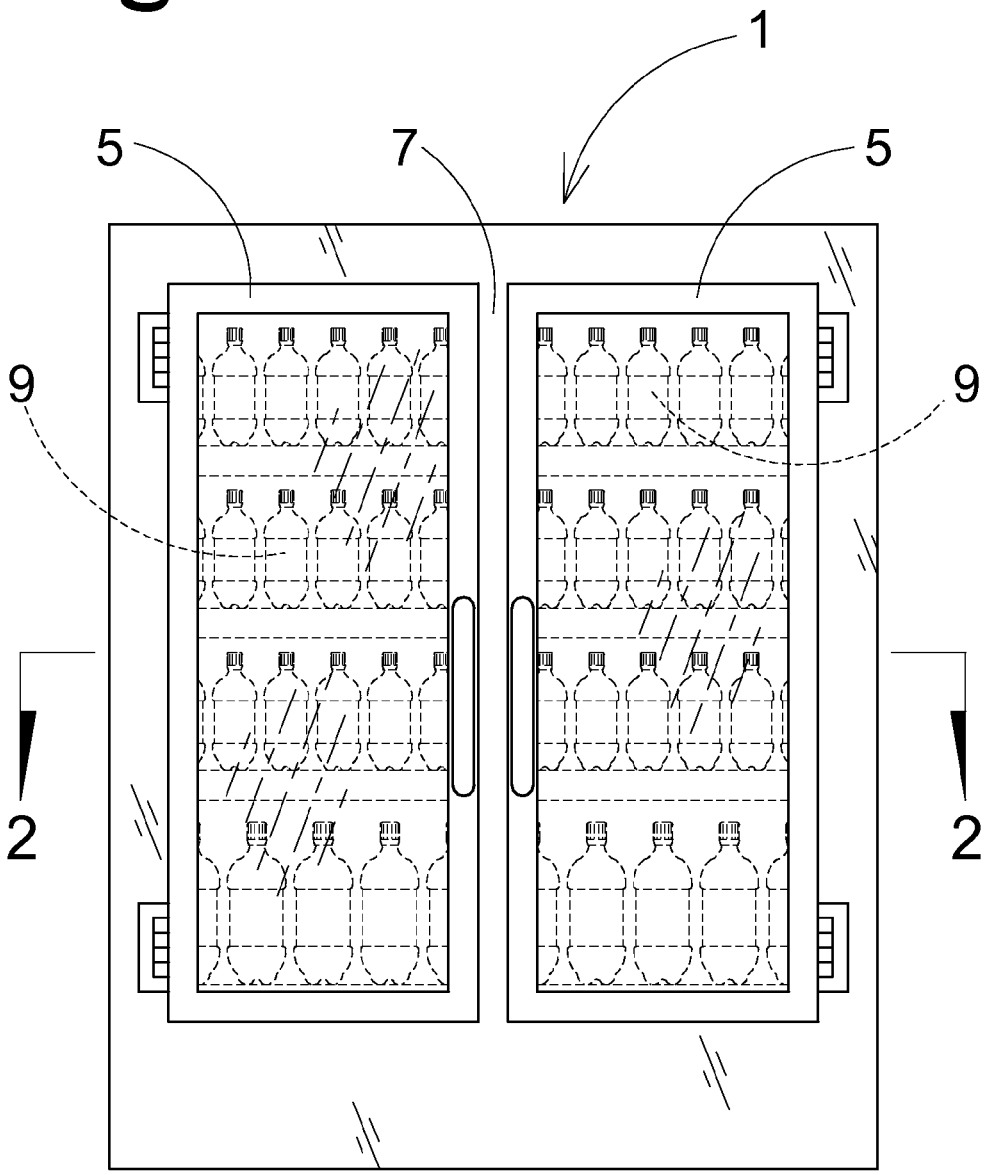
FIG. 1 is a cabinet display case wherein and embodiment of the invention is utilized.

Illustrated in FIG. 1 is an embodiment of a common type of cabinet display case (1). The cabinet display case (1) illustrated comprises a refrigerated cooler with transparent doors (5) and shelves for displaying product (9) but there are many other types of cabinet display cases (1) in which the present invention may be utilized, for example; non-refrigerated cases, curio cabinets, trophy cases, et cetera. It is also anticipated that an alternative cabinet display case (1) may have opaque doors wherein the lighting system may only illuminate the product (9) when the door is open.

The cabinet display case (1) includes a pair of doors (5) giving access to the cabinet's (1) interior through the apertures (3). Between the apertures (3) is the vertical structural member or mullion (7) to which the present invention may be mounted within or onto. Many cabinet display cases (1) have more than two apertures (3) and therefore a plurality of mullions (7) to which the invention may be applied.

Figure 2:
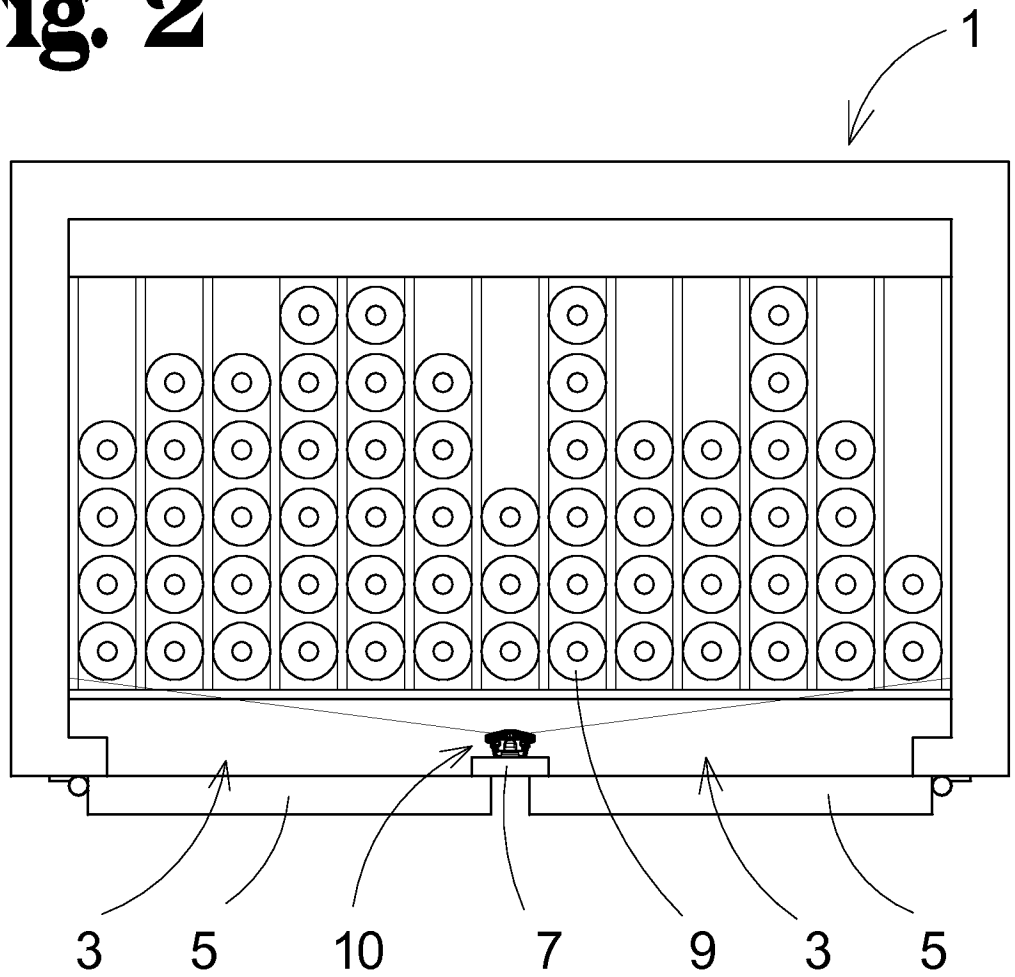
FIG. 2 is a cross sectional plan of the cabinet display case taken along line 2-2 of FIG. 1 and indicating the placement of an embodiment of the invention.

FIG. 2 is a cross section of the cabinet display case (1) illustrating the position of the product (9) in relation to the mullion (7) and the lighting system (10) therein. From this diagram it is obvious to see that if a lighting device that relies on standard light emitting diodes (22) is utilized while mounted to the mullion (7), and assuming that the light emitting diodes (22) use a standard mounting technique to a single printed circuit board (20), only the product (9) directly in front of the mullion (7) would be illuminated. The lines emanating from the lighting system (10) indicate the proper angles of light distribution for even and consistent illumination of the product (9) when the light source is mounted to the mullion (7).

Figure 3:
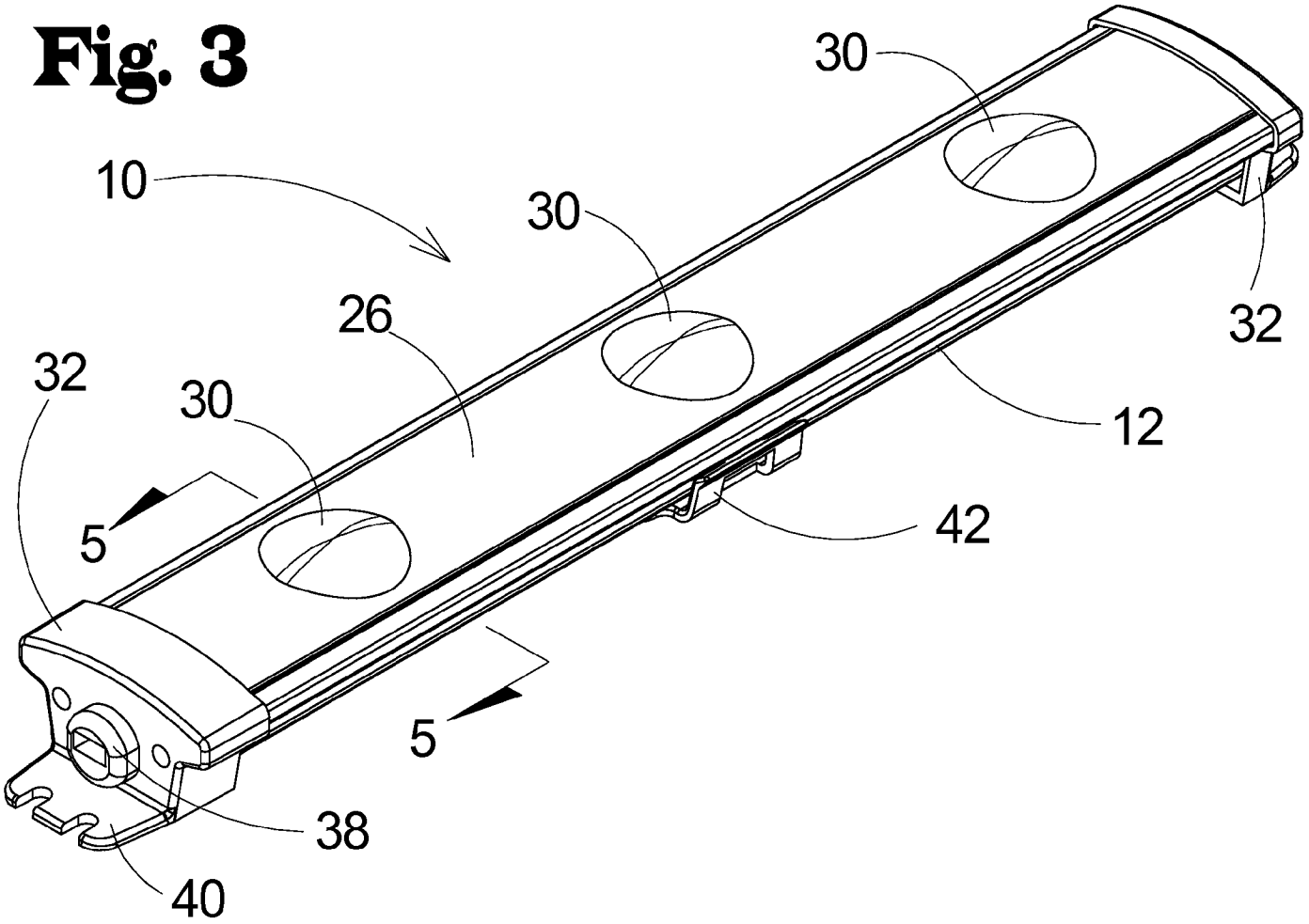
FIG. 3 is a perspective view of an embodiment of the invention.

FIG. 3 is a perspective view of the lighting system (10), showing the external components of the assembled unit. The main body of the lighting system (10) consists of a base (12) that forms a channel to receiver the unit's interior components. Capping the channel of the base (12) along the entire length of the base (12) is a bezel (26) that holds a number of lenses (30). The lenses (30) are set into the bezel (26) at a rotational angle so that the light distribution pattern is oriented to project the broadest field of light perpendicular to the length of the lighting system (10). The illustration is but an example of lens (30) placement and length and it is anticipated that the length of the base (12) and therefore the length of the lighting system (10) may be manufactured to any custom or standard length. Likewise the placement or spacing of lenses (30) on the bezel (26) may be closer, to the extent that lenses (30) may be in contact with one another, or may be very widely spaced lenses (30). Similarly the lenses (30) may be placed with uniform intervals as shown in FIG. 3 or unevenly spaced to accommodate specific or customized placement of shelves or product within the cabinet display case (1).

Each end of the lighting system (10) includes and end cap (32) which fulfills a number of functions. Primarily the end caps (32) provide integrity to the lighting system (10) holding the exterior components together and retaining the interior components inside the unit. The screw hole (34) in the end cap (32) provides a means to attach the end cap (32) to the base (12) through the agency of a tension channel (18) integrated into the base, but it is anticipated that many other means for fixing the end cap (32) to the base (12) are known to those skilled in the art. The end cap (32) also includes a conductor throughput (36) through which electrical conductors (not shown) for the lighting system (10) may be run. The conductor throughput (36) may be designed as simply an access point for wiring or include means to anchor the wires with a conduit plug (38). The conduit plug (38) allows passage of wires into the lighting system, an anchor point to prevent disconnection and a seal to prevent foreign material from entering the interior. It is anticipated that the conduit plug (38) may also include electrical contacts forming an electrical connector or pluggable connector for quick and easy connection of electrical conductors directly to the circuit connector (24) of the printed circuit board (20). The end cap (32) may also include the means for mounting the lighting system to the mullion (7) of the cabinet display case (1). The end cap shown in FIGS. 3 and 4 includes means for mounting the lighting system (10) such as the illustrated mounting flange (40) that is designed to engage the mullion (7) in a variety of ways. The methods anticipated in the demonstrative figures may employ screws, bolts or the like to hold the lighting system in place. Alternately a tongue may be formed between grooves to engage a loop provided in the mullion (7). Many methods of using the mounting flange (40) are anticipated including the use of adhesive pads mounted between the mounting flange (40) and the mullion (7).

Additional mounting means and apparatus may be required to properly support a lighting system (10) of considerable length. A medial mount (42) may be attached to the mullion (7) and be engaged to the lighting system (10). The medial mount (42) illustrated in FIGS. 3 and 4 include a pair of tension clips (44) which engage, mount engaging channels (14) integrated along the length of the base (12). A pair of bias leaves (46) would provide constant tension to the tension clips (44). This design allows the medial mount to be fixed to any portion of lighting system (10) along the length of the base (12).

Figure 4:
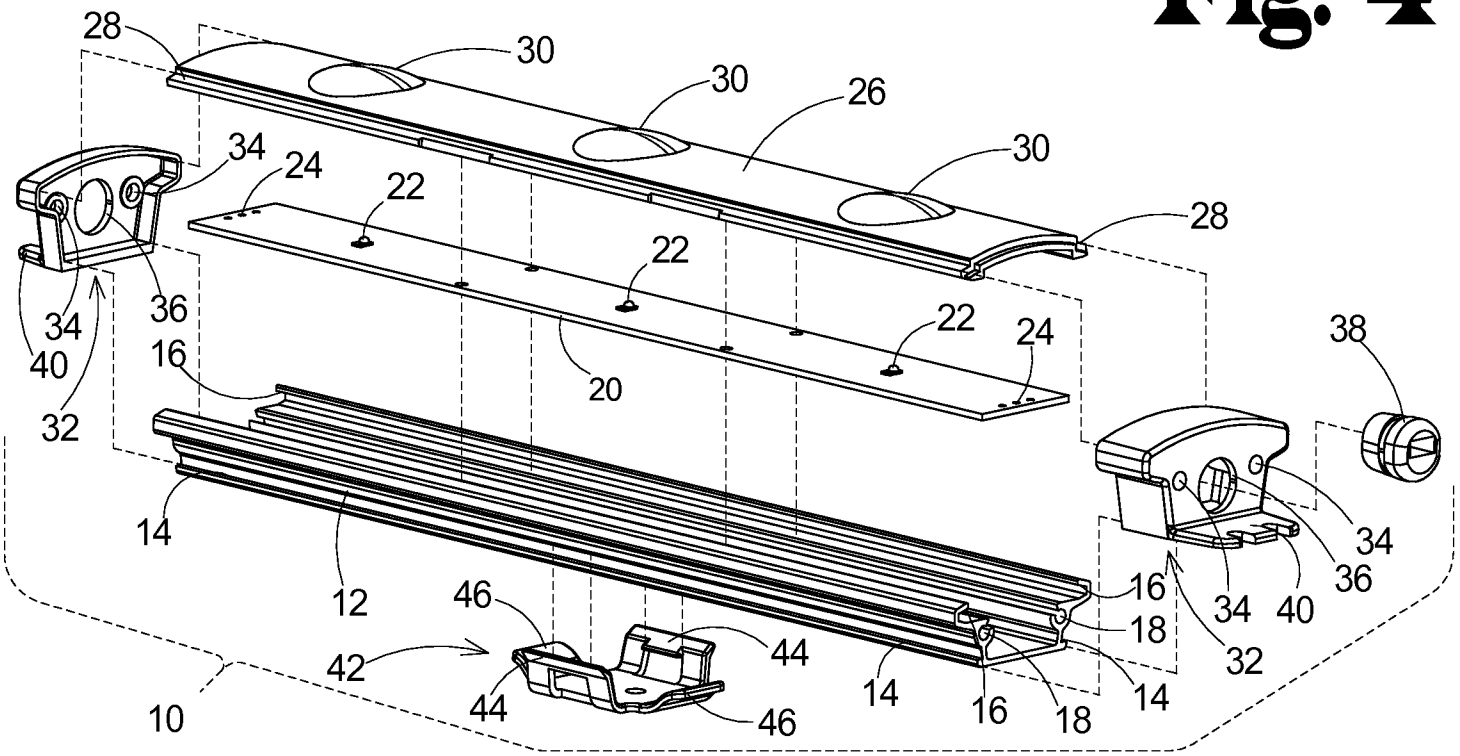
FIG. 4 is an exploded perspective view of an embodiment of the invention.

FIG. 4 is an exploded view of the lighting system (10) illustrating the unit's interior components and its method of assembly. It is apparent that the base (12) can be constructed from a continuous extrusion to reduce cost and make available any customized length of lighting system (10). The printed circuit board (20) is essential to the lighting system (10) as it includes the sources of light in the form of the light emitting diodes (22). Light emitting diodes (22) mounted on the printed circuit board (20) are mounted in an electrical circuit throughput, as is well known in the automated population of circuit boards (20) which is an economical standard in the industry. The printed circuit board (20) also includes the means of electrical distribution to the LEDs (22) and control thereof. Circuit connectors (24) are provided for connection to electrical conductors that carry power from a power source. It is anticipated that the printed circuit board (20) may comprise a pass through circuit with circuit connectors (24) on both ends of the printed circuit board (20) that would allow multiple lighting systems (10) to be connected in tandem.

The printed circuit board (20) is placed in the trough formed by the base (12). The bezel (26) is situated relative to the printed circuit board (20) so that the lenses (30) are positioned directly above the light emitting diodes (22). The contour of the interior of the bezel may be formed so that the printed circuit board (20) nests or interlocks into the bezel (26) to guarantee proper relative placement. The bezel (26) is retained by the base (12) within a pair of bezel retaining channels (16) integrated into the sides of the base (12) although other methods may be known to those skilled in the art.

Figure 5:
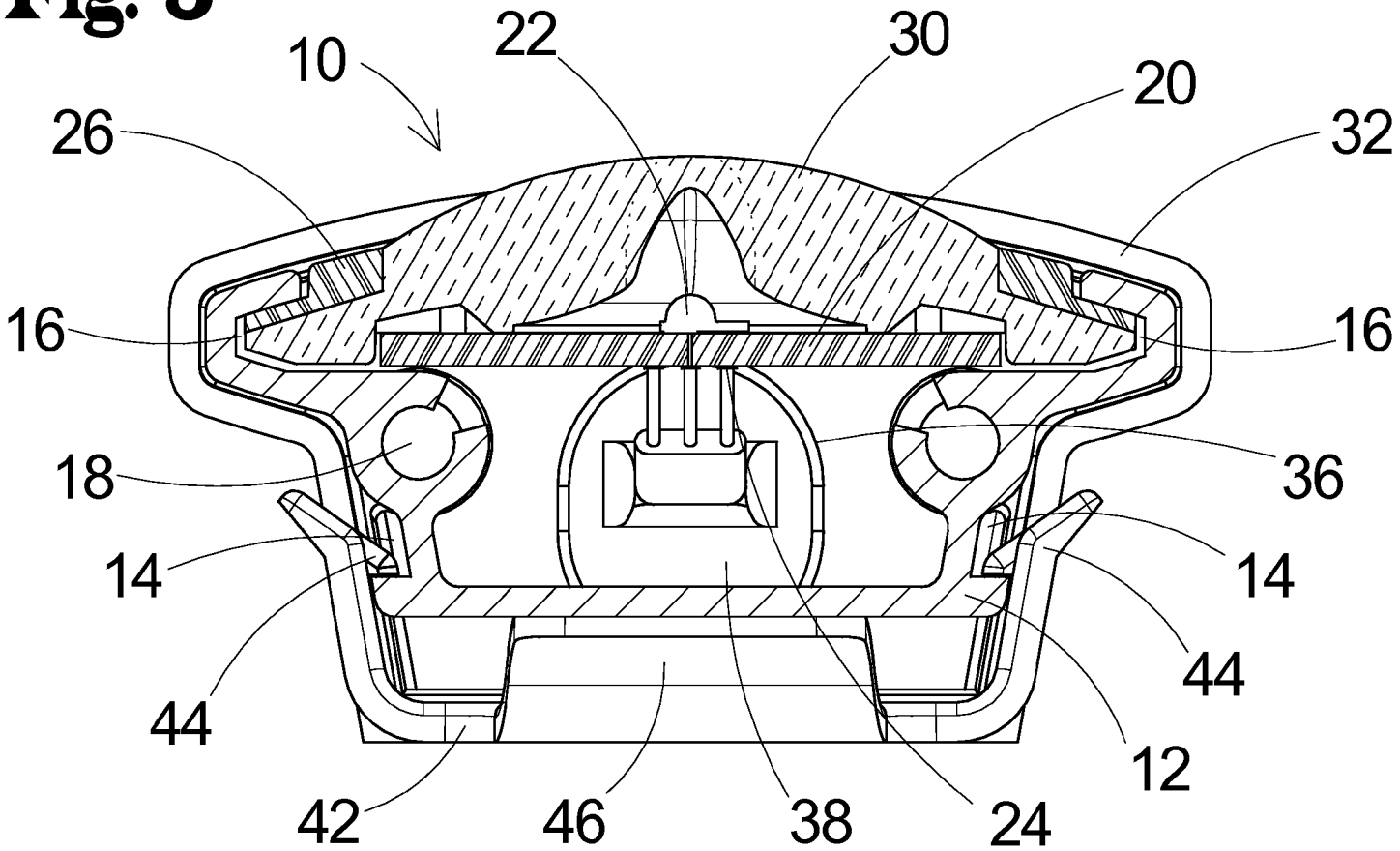
FIG. 5 is a cross sectional view of the interior of an embodiment of the present invention taken along line 5-5 of FIG. 3.

FIG. 5 is a cross sectional view of the lighting system (10) divided midway through one of the lenses (30). In this view of this particular embodiment the bezel (26) is only visible on the left and right of the lens (30). Portions of both the lens (30) and the bezel (26) are retained in the bezel retaining channels (16). The material of the lens (30) is in contact with and conforming around the printed circuit board (20) to hold it in place against portions of the base (12). The electrical conductors are visible coming through the conduit plug (38) and attaching to the printed circuit board (20) at the circuit connectors (24). The medial mount (42) is visible with its tension clips (44) inserted into the engaging channel (14) of the base (12) with the bias leaf in contact with the back of the base (12).

FIG. 5 illustrates the cross sectional interior lenticular topography of the lens (30) which redirects the conical light output pattern of the light emitting diode (22) to an elliptical pattern with the highest intensities of light directed towards an angle from 70 degrees to 90 degrees right and left of the cross section.

Figure 6:
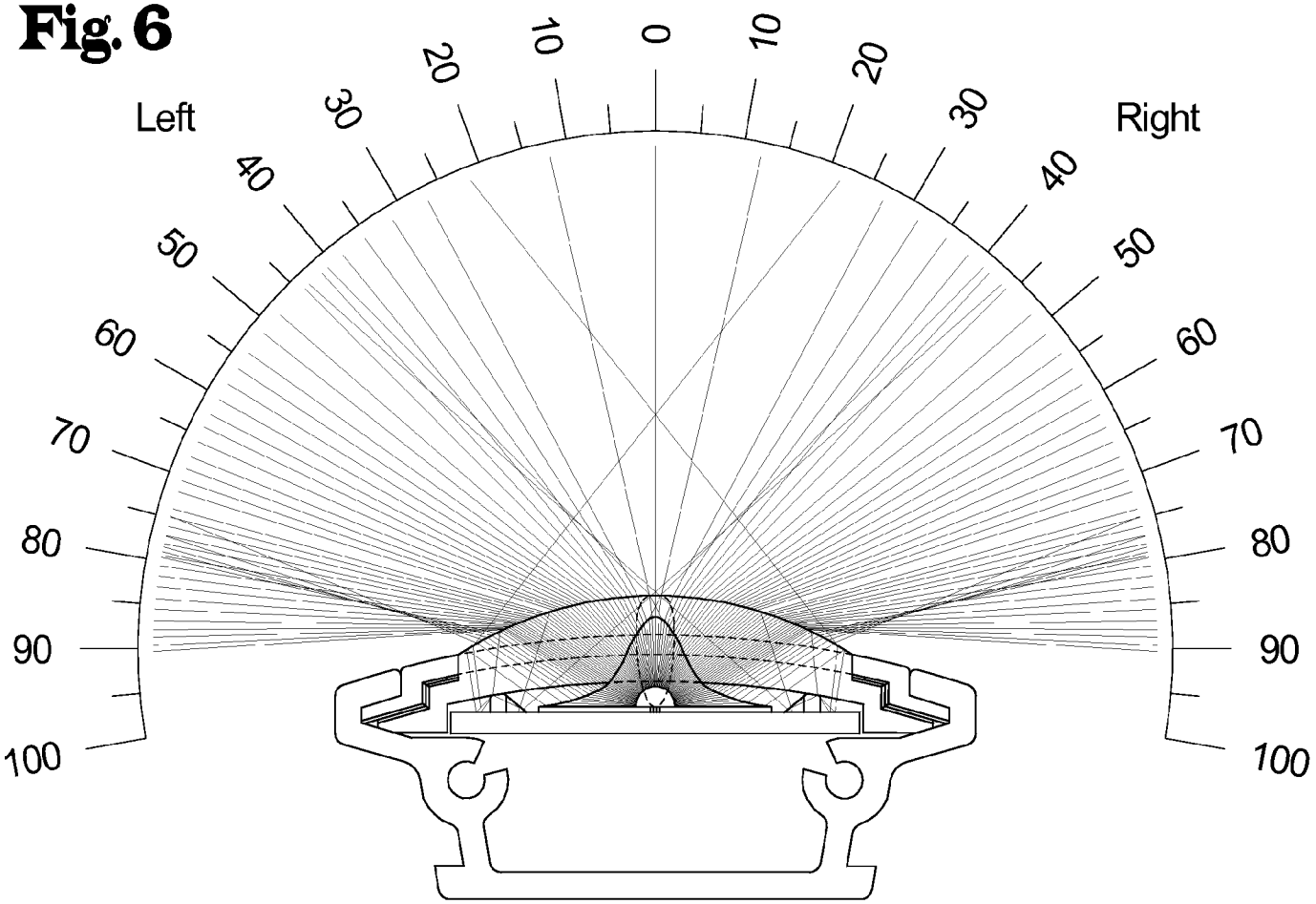
FIG. 6 is a cross sectional ray pattern diagram showing light intensity at angles in relation to the base of the lamp.

FIG. 6 demonstrates in a cross sectional ray pattern diagram the redirection and distribution of light passing through the lens (30). The light pattern output provided by the lens (30) allows the majority of the light to be directed in an acute angle right and left to illuminate product (9) that is the greatest distance from the lighting system (10) mounted to the mullion (7) thus presenting a even and consistent illumination for the product (9).

Figure 7:
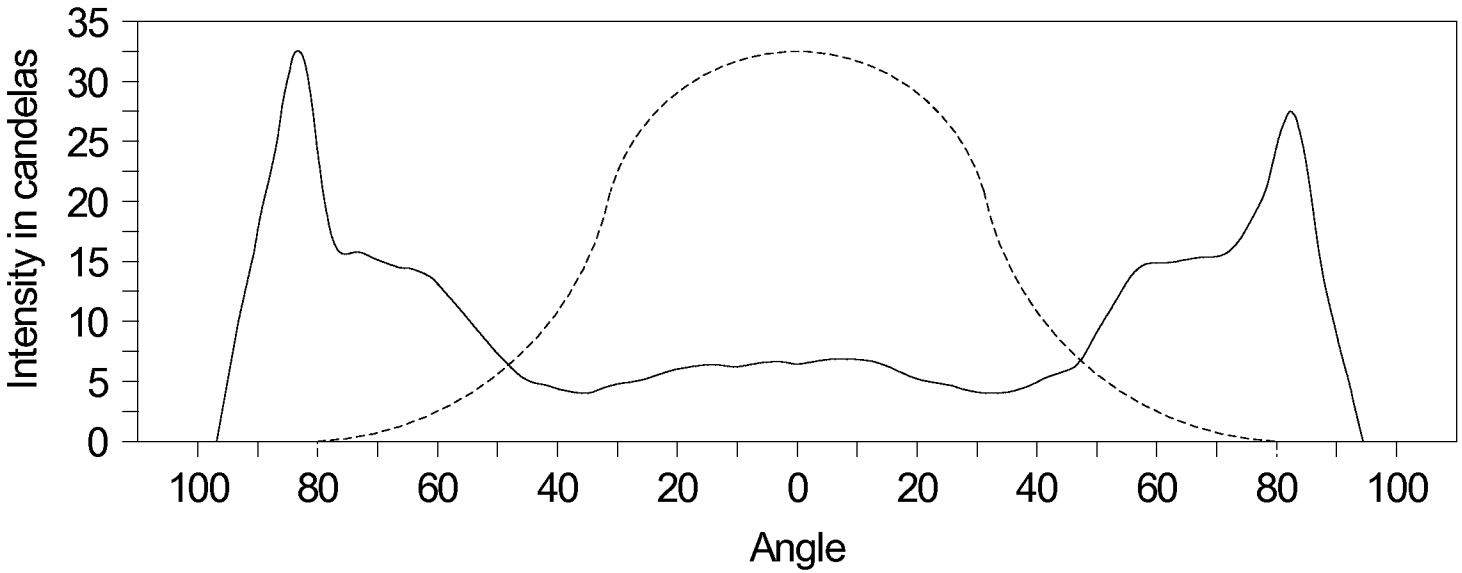
FIG. 7 is a graph showing the light intensity output of an unmodified light emitting diode and the light intensity output of a light emitting diode used with the lens of the present invention.

FIG. 7 is a graph showing two light output patterns. The first, represented with a dashed line, is the general light output pattern of an unmodified light emitting diode (22) with no redirection. The second, represented by the solid line, represents the light output pattern of a light emitting diode (22) modified by the lens (30) of the lighting system (10).

Figure 8:
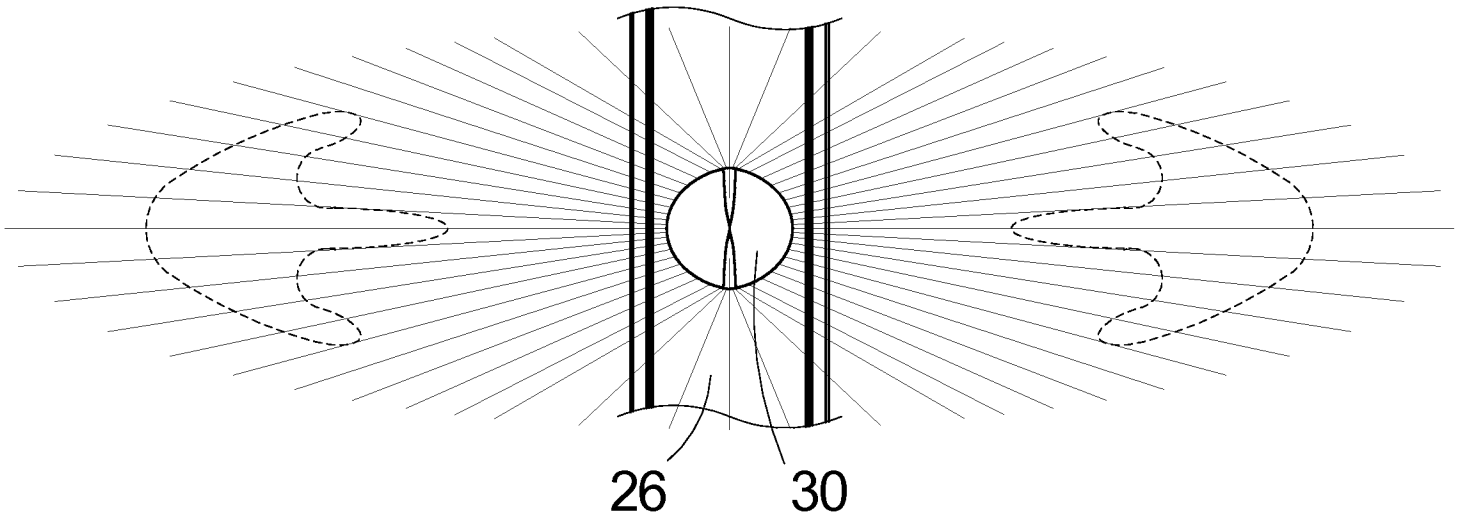
FIG. 8 is a light emission diagram depicting the light emission pattern of the present invention.

FIG. 8 illustrates the emission pattern of the light after passing through the lens (30). Since the majority of light is directed right and left to the base (12), as compared to the amount of light directed up and down along the length of the lighting system (10), the emission pattern can be defined as an ellipse rather than a traditional radial or circular emission pattern of the light emitting diode (22) alone. The areas defined by the dashed lines depict the areas of highest intensity illumination.

By combining the cross sectional output pattern in FIG. 7 and emission pattern of FIG. 8 the function of the lens (30) is made apparent. The ability of the lens (30) to redirect the light of a light emitting diode (22) in this particular pattern is directly applicable to the specific problem of light distribution within a cabinet display case so as to provide even and consistent illumination to the product (9) therein.

The ability to redirect the light of a light emitting diode (22) in such a manner as to allocate equivalent amounts of light to products both close and distant proximity will allow the even and consistent lighting of product (9) within a cabinet display case (1) while also preserving an uncomplicated placement of the lighting system (10) to the mullion (7) and a simplified manufacturing process with a coplanar printed circuit board (20) in relation to the base (12) and the use of standard automated pick and place techniques for mounting the light emitting diodes (22) to a printed circuit board (20).

It should be appreciated from the foregoing description and the many variations and options disclosed that, except when mutually exclusive, the features of the various embodiments described herein may be combined with features of other embodiments as desired while remaining within the intended scope of the disclosure.

It is to be understood that the above description is intended to be illustrative, and not restrictive. Many other embodiments and combinations of elements will be apparent to those skilled in the art upon reviewing the above description and accompanying drawings. The scope of the invention should, therefore, be determined with reference to the appended claims, along with the full scope of equivalents to which such claims are entitled.

What is claimed is:

1. A lighting system comprising:
a base;
an end cap;
a printed circuit board including;
a plurality of light emitting diodes; and
a bezel; and
a plurality of lenses held in place by the bezel, a lens for each of the plurality of light emitting diodes, each lens disposed in the bezel in relation to its respective light emitting diode to provide a light output pattern wherein the highest intensities of light are directed at substantially right and left angles to said base.

2. The lighting system of claim 1 wherein the base comprises a means for mounting.

3. The lighting system of claim 2 wherein the base includes a mount engaging channel.

4. The lighting system of claim 3 further comprising a medial mount comprising:
a tension clip; and
a bias leaf that engages the mount engaging channel.

5. The lighting system of claim 1 wherein the end cap includes a means for mounting.

6. The lighting system of claim 5 wherein the mounting means comprises a mounting flange.

7. The lighting system of claim 1 wherein the printed circuit board includes circuit connectors.

8. The lighting system of claim 7 wherein the circuit connectors comprise a pluggable connector.

9. The lighting system of claim 1 including a conduit plug for passing electrical conductors to the printed circuit board.

10. The lighting system of claim 9 wherein the conduit plug comprises a pluggable connector.

11. The lighting system of claim 7 wherein the printed circuit board includes a plurality of circuit connectors.

12. The lighting system of claim 1 wherein the printed circuit board comprises a pass through circuit that allows a second lighting system to be electrically connected in tandem.

13. The lighting system of claim 1 wherein said light output pattern of each light emitting diode is directed at substantially 70 degree to 90 degree angle left and right to said base.

14. The lighting system of claim 13 wherein the base includes a bezel retaining channel.

15. The lighting system of claim 1 wherein the bezel includes contouring to nest with the printed circuit board in a manner to provide relative placement of each light emitting diode and its respective lens.

16. The lighting system of claim 1 wherein the bezel includes contouring to interlock with the printed circuit board in a manner to provide proper relative placement of each light emitting diode and its respective lens.

17. The lighting system of claim 1 wherein the printed circuit board fits within a trough of the base in a manner to provide proper relative placement of each light emitting diode and its respective lens.

18. The lighting system of claim 1 disposed within a cabinet display case.

19. The lighting system of claim 18 mounted to the mullion in a manner as to provide even and consistent light to the product therein.

20. A lighting system mounted to the mullion within a cabinet display case comprising:

a base comprising
- a mounting engaging channel and
- a bezel retaining channel;

an end cap comprising
- a mounting flange and
- a conductor throughput;

a printed circuit board comprising
- a plurality of light emitting diodes,
- a circuit connector, and
- a pass through circuit;

a bezel; and a plurality of lenses held in place by the bezel, a lens for each of the plurality of light emitting diodes, each lens disposed in the bezel in relation to its respective light emitting diode to provide a light output pattern wherein the highest intensities of light is directed at angles from 70 degrees to 90 degrees right and left of said base, and wherein the bezel is contoured to provide proper relative placement of each light emitting diode to its respective lens.

* * * * *